US006299414B1

(12) United States Patent
Schoenmeyr

(10) Patent No.: US 6,299,414 B1
(45) Date of Patent: Oct. 9, 2001

(54) FIVE CHAMBER WOBBLE PLATE PUMP

(75) Inventor: Ivar L Schoenmeyr, San Juan Capistrano, CA (US)

(73) Assignee: Aquatec Water Systems, Inc., Irvine, CA (US)

( * ) Notice: Subject to any disclaimer, the term of this patent is extended or adjusted under 35 U.S.C. 154(b) by 0 days.

(21) Appl. No.: 09/440,452

(22) Filed: Nov. 15, 1999

(51) Int. Cl.[7] ..... F04B 3/00
(52) U.S. Cl. ..... 417/244
(58) Field of Search ..... 417/244, 269, 417/572, 44.2

(56) References Cited

U.S. PATENT DOCUMENTS 4,507,058 * 3/1985 Schoenmeyr ..... 417/270
5,079,996 * 1/1992 Abousabha et al. ..... 92/12.2
5,476,367 * 12/1995 Zimmermann et al. ..... 417/307
5,531,576 * 7/1996 Kussmann ..... 418/53
5,626,464 * 5/1997 Schoenmeyr et al. ..... 417/269
6,089,838 * 7/2000 Schoenmeyr et al. ..... 417/572

* cited by examiner

*Primary Examiner*—Teresa Walberg
*Assistant Examiner*—Vinod D Patel
(74) *Attorney, Agent, or Firm*—Irell & Manella LLP

(57) ABSTRACT

A pump that has an inlet manifold passage with a varying cross-sectional area. The manifold passage provides fluid communication between an inlet port and a plurality of pump chambers within the pump. The varying cross-sectional area may reduce the likelihood of air being entrapped in the pump chambers. Each pump chamber may have a corresponding piston that moves in a reciprocating manner within the chamber. The pistons may be moved by a motor driven wobble plate. Movement of the pistons may pull fluid into the pump chambers through corresponding inlet valves and into an outlet port through corresponding outlet valves. The valves may cooperate with valve seats that each have an outer radius smaller than an inner radius. The pump may have an in-line check valve that controls fluid flow from an outlet manifold passage to the outlet port, and a pressure sensor in fluid communication with the outlet port. The motor may have a leak detector integrated into the metal shell and fasteners of the motor assembly.

20 Claims, 2 Drawing Sheets

FIVE CHAMBER WOBBLE PLATE PUMP

BACKGROUND OF THE INVENTION

1. Field of the Invention

The present invention relates to a wobble plate pump and motor assembly.

2. Background Information

U.S. Pat. No. 5,626,464 issued to Schoenmeyr et al. discloses a wobble plate pump that is produced by the assignee Aquatec Water Systems, Inc. The Aquatec pump has three pump pistons that move in a reciprocating manner within corresponding pump chambers. The reciprocating movement of the pistons pump fluid from an inlet port to an outlet port of the pump. The pistons are moved by a wobble plate that is rotated by an electric motor.

When a pump is initially activated there may be air in both the inlet and outlet lines. During start up the pump will undergo a priming phase wherein both fluid and air are pulled into the pump chambers. Because of gravity the fluid will tend to flow into and fill the lower pump chambers before filling the upper chamber(s). The filled lower pump chambers may create a back pressure in the outlet line that essentially traps air within the upper pump chamber(s). In a steady state operation the piston in the upper chamber merely compresses and expands the air and becomes inoperative. The loss of a chamber reduces the output of the pump. It would be desirable to provide a fluid pump that reduces the likelihood of air lock within the pump chambers.

The electronic motor that drives the wobble plate must be sealed by a diaphragm to prevent fluid from coming into contact with the motor windings and shorting the motor. The diaphragm may develop a crack that allows water to leak into the motor. The water may create an electrical short that damages the motor. It would be desirable to provide a leak detector that can detect leakage in the winding area. It would also be desirable provide a leak detector that is relatively inexpensive to incorporate into the motor assembly. Additionally, it would be desirable to provide a means to stop the pump upon detection of a leak to prevent damage to the motor.

Wobble plate water pumps typically contain a one-way outlet check valve that is integrated into the pump. The check valve may fail thereby rendering the pump inoperable. It would be desirable to provide a wobble plate pump that allows someone to replace the check valve.

The Aquatec pump has a plurality of inlet and outlet valves located within valve seats of the pumps. The valve seats are molded in a shape that is a segment of a sphere. It is difficult to mold a true spherical shape. Any non-conforming shape may create an improper seating of the valves. It would be desirable to provide valve seats that are easier to mold and still effective.

SUMMARY OF THE INVENTION

One embodiment of the present invention is a pump that has an inlet manifold passage with a varying cross-sectional area. The manifold passage provides fluid communication between an inlet port and a plurality of pump chambers within the pump. Each pump chamber may have a corresponding piston that moves in a reciprocating manner within the chamber. The pistons may be moved by a motor driven wobble plate. Movement of the pistons may pull fluid into the pump chambers through corresponding inlet valves and into an outlet port through corresponding outlet valves.

DETAILED DESCRIPTION

Figure 1:
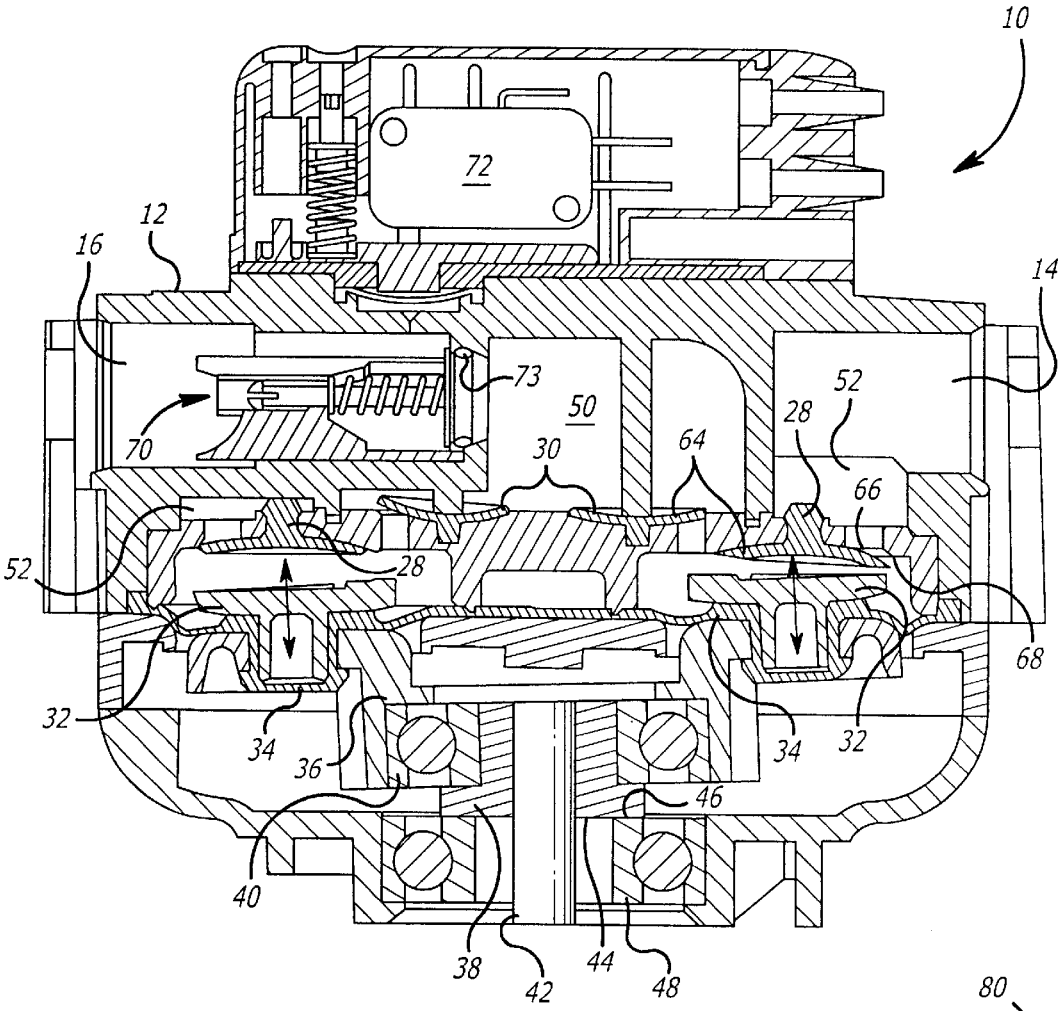
FIG. 1 is a cross-sectional view of an embodiment of a pump of the present invention.

Referring to the drawings more particularly by reference numbers, FIGS. 1–4 show an embodiment of a pump 10 of the present invention. The pump 10 includes a housing 12 that has an inlet port 14 and an outlet port 16. The inlet 14 and outlet 16 ports are typically connected to an inlet fluid line (not shown) and an outlet fluid line (not shown), respectively. The pump 10 may include a first pump chamber 18, a second pump chamber 20, a third pump chamber 22, a fourth pump chamber 24 and a fifth pump chamber 26. Each pump chamber 18, 20, 22, 24 and 26 may have an inlet valve 28 and an outlet valve 30.

Each pump chamber 18, 20, 22, 24 and 26 may contain a corresponding piston 32. Each piston 32 may be connected to a diaphragm 34 and a rocker arm 36. The rocker arm 36 may be coupled to a wobble plate 38 by a first bearing assembly 40. The wobble plate 38 may be connected to a rotating output shaft 42 of a motor (not shown in FIG. 1). The wobble plate 38 may have a cam surface 44 that slides along a corresponding surface 46 of a second bearing assembly 48.

Rotation of the output shaft 42 turns the wobble plate 38 and moves the pistons 32 in a reciprocating manner as indicated by the arrows. Movement of the pistons 32 away from the inlet valves 28 draws fluid into the pump chambers 18, 20, 22, 24 and 26. Movement of the pistons 32 toward the inlet valves 28 pushes fluid from the pump chambers 18, 20, 22, 24 and 26 into an outlet manifold passage 50.

Figure 3:
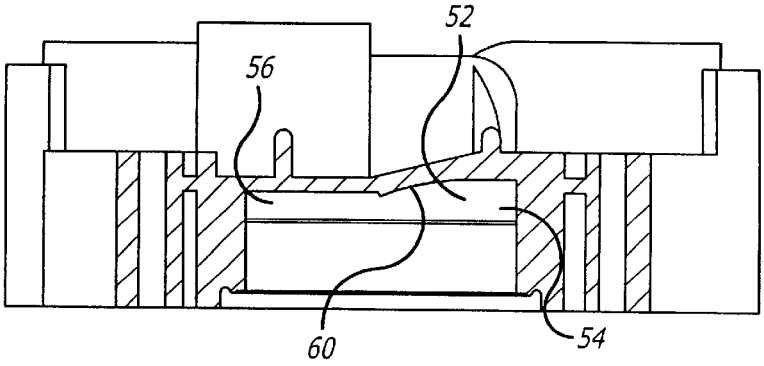
FIG. 3 is a cross-sectional view taken at line 3—3 of FIG. 2.
Figure 2:
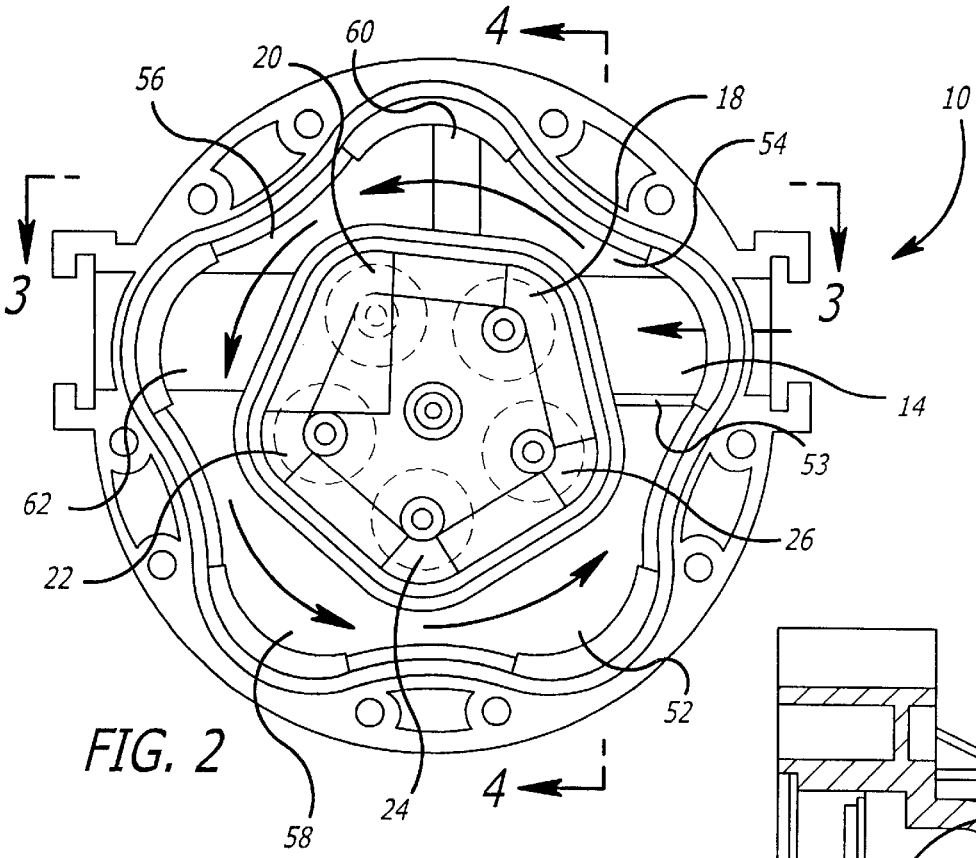
FIG. 2 is a cross-sectional view showing an inlet manifold passage of the pump.
Figure 4:
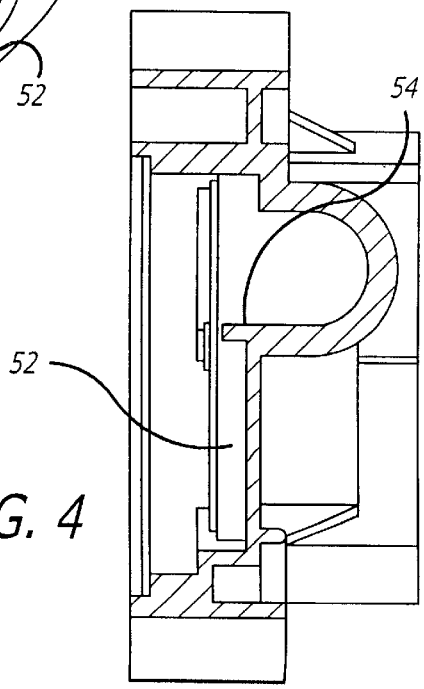
FIG. 4 is a cross-sectional view taken at line 4—4 of FIG. 2.

As shown in FIGS. 2, 3 and 4 the pump 10 may have an inlet manifold passage 52 that provides fluid communication between the inlet port 14 and the pump chambers 18, 20, 22, 24 and 26. The pump 10 is typically oriented so that the first 18 and second 20 pump chambers are located above the third 22, fourth 24 and fifth 26 pump chambers. The inlet port 14 is located adjacent to the upper first pump chamber 18. The manifold passage 52 has a barrier 53 so that fluid flows through the passage 52 in a direction from the first pressure chamber 18 to the fifth pressure chamber 26 as indicated by the arrows.

The inlet manifold passage 52 has a varying cross-sectional area. In general the cross-sectional area adjacent to the first pump chamber 18 is greater than the cross-sectional area adjacent to the fifth pump chamber 26. The larger cross-sectional area lowers the fluid resistance and together with the direction of flow within the passage 52 increases the likelihood of fluid flowing into the first pump chamber 18 before the fifth pressure chamber 26. Increasing the flow into the first 18 and second pump chambers reduces the likelihood of air being entrapped in the chambers 18 and 20 during a priming phase of the pump 10.

The inlet manifold passage 52 may have three distinct regions 54, 56 and 58 that each have a different depth and corresponding cross-sectional area. The first region 54 has a depth that is greater than the second region 56. The second region 56 has a depth that is greater than the third region 58. The manifold passage 52 may have tapered transitions 60 and 62 between the regions 54, 56 and 58. As an alternative embodiment the passage 52 may have a gradually varying depth.

In one embodiment the manifold passage 52 may have an initial area that is approximately equal to the inlet port 14 and have a reduction in area that is approximately one-half the area of the inlet port 14. In general, each section of the passage may have an area proportional to the maximum flow with that area. Additionally, any change in the shape of the manifold passage should be gradual to minimize losses in the passage 52.

The motor (not shown) may actuate the pistons 32 so that pump chambers 18, 20, 22, 24 and 26 draw in fluid sequentially. For example, the pump 10 may operate so that fluid is initially pulled into the first pump chamber 18, then fluid is pulled into the second pump chamber 20, then into the third pump chamber 22 and fourth pump chamber 24, and finally fluid is pulled into the fifth pump chamber 26. This sequence further induces fluid flow from the first chamber 18 to the fifth chamber 26 and also reduces the likelihood of air entrapment within the first 18 and second 20 pump chambers.

Referring to FIG. 1, each inlet 28 and outlet 30 valve may be seated against a valve seat 64. Each valve seat 64 may have an inner radius 66 and an outer radius 68. The outer radius 68 may be smaller than the inner radius 66. The inner radius 66 may be a segment of a sphere. The outer radius 68 may be a segment of a circle. It is easier to mold a segment of a circle. Thus the pump 10 has less manufacturing non-conformities. Additionally, the circular outer radius 68 increases the likelihood of valve buckling which improves the performance of the valves 28.

The pump 10 may have a one-way check valve 70 that controls the flow of fluid from the outlet manifold passage 50 to the outlet port 16. The check valve 70 prevents a reverse flow of fluid from the outlet port 16 into the manifold passage 50. The check valve 70 is located in-line with the outlet port 16 so that someone can pull out and replace the valve 72. The valve 72 has an O-ring 73 that presses into the housing 12. The pump 10 may further have a pressure sensor 72 that can sense the pressure within the outlet port 16. The pressure sensor 72 can be connected to electrical circuits that control the operation of the pump 10. The pump 10 is typically switched on when the outlet line pressure falls below a lower threshold and switched off when the pressure exceeds an upper threshold. It is preferable to locate the pressure sensor 72 in the outlet port 16 downstream from the check valve 70 so that the pump 10 does not toggle between the on and off states during the operation of the pump 10.

Figure 5:
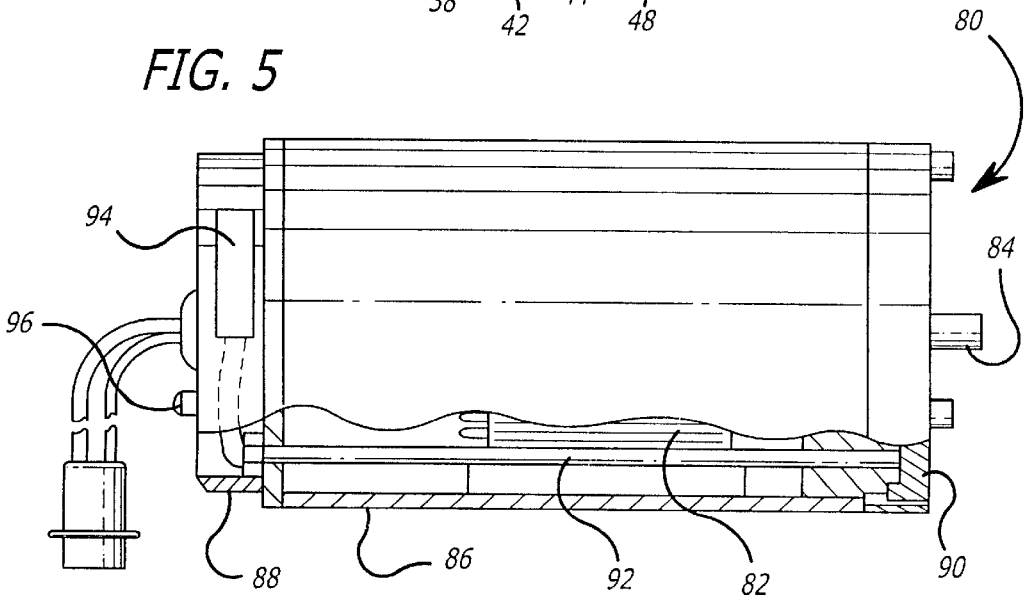
FIG. 5 is a side sectional view of a motor assembly.

FIG. 5 shows an embodiment of a motor assembly 80 that can drive the pump shown in FIG. 1. The assembly 80 may include a motor 82 that has an output shaft 84. The output shaft 84 may be the same as shaft 42 shown in FIG. 1. Although the motor assembly 80 is described as being coupled to the pump embodiment shown in FIG. 1, it is to be understood that the assembly 80 may be coupled to other pumps.

The motor assembly 80 may include an electrically conductive outer shell 86 that is attached to a pair of non-conductive end pieces 88 and 90. The assembly 80 may have a plurality of electrically conductive fasteners 92 that press the end pieces 88 and 90 into the outer shell 86. The conductive fasteners 92 are electrically decoupled from the outer shell 86. The outer shell 86 and one of the fasteners 92 can be electrically connected to a leak detector circuit 94. The leak detector circuit 94 may include an indicator 96 that is activated when a fluid leaks into the assembly 80 and reaches a level which creates an electrical path between the fastener 92 and the outer shell 86. The fastener 92, outer shell 86 and fluid in essence creates a fluidic switch.

The indicator 96 may be a light source such as a light emitting diode (LED) that is illuminated. Alternatively, or in addition to, the detector circuit 94 may include an audio alarm that is activated when the fluid level reaches the fastener 92. Incorporating the fastener 92 and shell 86 into the leak detector provides a detector that is relatively inexpensive to integrate into an existing motor assembly design. The fastener 92 used in the detector circuit should be at an elevation below the motor 82 so that the existence of fluid within the assembly 10 is detected before making contact with the motor windings.

The circuit 94 may also contain a switch such as a solid state relay that terminates power to the motor 82 upon detection of a leak. Terminating power will shut off the pump and reduce the amount of water that leaks into the motor 82.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A pump, comprising:

a housing that has an inlet port, an outlet port, a plurality of pump chambers and an inlet manifold passage that provides fluid communication between said inlet port and said pump chambers, said inlet manifold passage having a varying cross-sectional area as said inlet manifold passage extends around said pump chambers;

a plurality of inlet valves that control fluid communication between said inlet manifold passage and said pump chambers;

a plurality of outlet valves that control fluid communication between said pump chambers and said outlet port;

a plurality of pistons adapted to move within said pump chambers; and, a wobble plate adapted to be rotated and move said pistons within said pump chambers.

2. The pump of claim 1, wherein said inlet manifold passage includes a barrier.

3. The pump of claim 1, wherein said pump chambers include a first pump chamber, a second pump chamber, a third pump chamber, a fourth pump chamber and a fifth pump chamber, said pistons move within said first, second, third, fourth and fifth pump chambers so that fluid flows into and out of said first, second, third, fourth and fifth pump chambers sequentially.

4. The pump of claim 3, wherein said inlet manifold passage has a smaller cross-sectional area adjacent to said fifth pump chamber than a cross-sectional area adjacent to said first pump chamber.

5. The pump of claim 3, wherein said inlet port is adjacent to said first pump chamber.

6. The pump of claim 5, wherein said inlet manifold passage has a barrier between said first and fifth pump chambers.

7. The pump of claim 1, wherein said inlet valves are each located adjacent to a valve seat that has an inner radius and an outer radius.

8. The pump of claim 7, wherein said outer radius is smaller than said inner radius.

9. The pump of claim 1, further comprising a check valve that controls flow between an outlet manifold passage and said outlet port, and a pressure sensor in fluid communication with said outlet port.

10. The pump of claim 1, further comprising a motor that rotates said wobble plate.

11. The pump of claim 10, wherein said motor includes a leak detector.

12. A pump, comprising:

a housing that has an inlet port and an outlet port, a plurality of pump chambers, each pump chamber having an inlet valve seat and an outlet valve seat, each inlet valve seat and outlet valve seat having an inner radius and an outer radius;

a plurality of inlet valves that cooperate with said inlet valve seats to control fluid communication between said inlet port and said pump chambers;

a plurality of outlet valves that cooperate with said outlet valve seats to control fluid communication between said pump chambers and said outlet port;

a plurality of pistons adapted to move within said pump chambers; and, a wobble plate adapted to be rotated and move said pistons within said pump chambers.

13. The pump of claim 12, wherein said outer radius is smaller than said inner radius.

14. The pump of claim 12, further comprising a check valve that controls flow between an outlet manifold passage and said outlet port, and a pressure sensor located within said outlet port.

15. The pump of claim 12, further comprising a motor that rotates said wobble plate.

16. The pump of claim 15, wherein said motor includes a leak detector.

17. A pump, comprising:

a housing that has an inlet port, a plurality of pump chambers, an outlet port and an outlet manifold passage;

a plurality of inlet valves that control fluid communication between said inlet port and said pump chambers;

a plurality of outlet valves that control fluid communication between said pump chambers and said outlet port;

a check valve that controls fluid communication between said outlet manifold passage and said outlet port and is located in-line with said outlet port;

a plurality of pistons adapted to move within said pump chambers; and, a wobble plate adapted to be rotated and move said pistons within said pump chambers.

18. The pump of claim 17, further comprising a pressure sensor in fluid communication with said outlet port.

19. A motor assembly, comprising:

a housing that has a conductive shell and a non-conductive end piece;

a conductive fastener that is attached to said non-conductive end piece;

a leak detector circuit that is connected to said conductive shell and said conductive fastener; and, a motor located within said housing.

20. The motor assembly of claim 19, wherein said leak detector circuit includes an indicator that is activated when a fluid creates an electrical path between said conductive fastener and said conductive shell.

* * * * *